US008107642B2

(12) United States Patent
Acero et al.

(10) Patent No.: US 8,107,642 B2
(45) **Date of Patent: *Jan. 31, 2012**

(54) SPATIAL NOISE SUPPRESSION FOR A MICROPHONE ARRAY

(75) Inventors: Alejandro Acero, Bellevue, WA (US); Ivan J. Tashev, Kirkland, WA (US); Michael L. Seltzer, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 435 days.

This patent is subject to a terminal disclaimer.

(21) Appl. No.: 12/464,390

(22) Filed: May 12, 2009

(65) Prior Publication Data

US 2009/0226005 A1 Sep. 10, 2009

Related U.S. Application Data

(62) Division of application No. 11/316,002, filed on Dec. 22, 2005, now Pat. No. 7,565,288.

(51) Int. Cl.
*H04R 3/00* (2006.01)
*G10L 21/02* (2006.01)

(52) U.S. Cl. ..... 381/92; 704/226

(58) Field of Classification Search ..... 381/92, 381/122, 94.1; 704/226, 228, 233, E15.015, 704/E15.039, E21.002, E21.004
See application file for complete search history.

(56) References Cited

U.S. PATENT DOCUMENTS

| | | | | |
|---|---|---|---|---|
| 5,012,519 | A | 4/1991 | Adlersberg et al. | 704/226 |
| 5,208,864 | A * | 5/1993 | Kaneda | 704/258 |
| 5,839,101 | A | 11/1998 | Vahatalo et al. | 704/226 |
| 6,041,127 | A | 3/2000 | Elko | |
| 6,289,309 | B1 | 9/2001 | DeVries | 704/233 |
| 6,643,619 | B1 | 11/2003 | Linhard et al. | 704/233 |
| 6,778,954 | B1 | 8/2004 | Kim et al. | 704/226 |
| 6,914,854 | B1 | 7/2005 | Heberley et al. | 367/119 |
| 7,080,007 | B2 | 7/2006 | Son et al. | 704/210 |
| 7,139,711 | B2 | 11/2006 | Grover | 704/260 |
| 7,366,658 | B2 | 4/2008 | Moogi et al. | 704/205 |
| 7,415,117 | B2 | 8/2008 | Tashev et al. | |
| 7,565,288 | B2 | 7/2009 | Acero et al. | |
| 2002/0002455 | A1 | 1/2002 | Accardi et al. | 704/226 |

(Continued)

OTHER PUBLICATIONS

S. Laugesen, K. Rasmussen, T. Christiansen, "Design of a Microphone Array for Headsets," IEEE Workshop on Applications of Signal Processing to Audio and Acoustics, Oct. 2003, New Paltz, NY.

(Continued)

*Primary Examiner* — Hai Phan
(74) *Attorney, Agent, or Firm* — Steven M. Koehler; Westman, Champlin & Kelly, P.A.

(57) ABSTRACT

A noise reduction system and a method of noise reduction includes a microphone array comprising a first microphone, a second microphone, and a third microphone. Each microphone has a known position and a known directivity pattern. An instantaneous direction-of-arrival (IDOA) module determines a first phase difference quantity and a second phase difference quantity. The first phase difference quantity is based on phase differences between non-repetitive pairs of input signals received by the first microphone and the second microphone, while the second phase difference quantity is based on phase differences between non-repetitive pairs of input signals received by the first microphone and the third microphone. A spatial noise reduction module computes an estimate of a desired signal based on a priori spatial signal-to-noise ratio and an a posteriori spatial signal-to-noise ratio based on the first and second phase difference quantities.

14 Claims, 7 Drawing Sheets

U.S. PATENT DOCUMENTS

| | | | | |
|---|---|---|---|---|
| 2003/0177006 | A1 | 9/2003 | Ichikawa et al. | 704/231 |
| 2004/0037436 | A1 | 2/2004 | Rui | 381/92 |
| 2004/0049383 | A1 | 3/2004 | Kato et al. | 704/226 |
| 2004/0175006 | A1 | 9/2004 | Kim et al. | 704/226 |
| 2004/0230428 | A1 | 11/2004 | Choi | 704/226 |
| 2005/0195988 | A1 | 9/2005 | Tashev et al. | |
| 2005/0276361 | A1* | 12/2005 | Kim et al. | 375/347 |
| 2007/0127736 | A1* | 6/2007 | Christoph | 381/92 |
| 2008/0019535 | A1* | 1/2008 | Mitsuhashi et al. | 381/66 |
| 2008/0288219 | A1* | 11/2008 | Tashev et al. | 702/190 |
| 2009/0141908 | A1* | 6/2009 | Jeong et al. | 381/92 |

OTHER PUBLICATIONS

C. Lai, P. Aarabi, "Multiple-Microphone Time-Varying Filters for Robust Speech Recognition," ICASSP 2004, Montreal, May 2004.

X. Zhang, Y. Jia, "A Soft Decision Based Noise Cross Power Spectral Density Estimation for Two-Microphone Speech Enhancement Systems," ICASSP 2005, Philadelphia, Mar. 2005.

I. Tashev, H. Malvar, "A New Beamformer Design Algorithm for Microphone Arrays," ICASSP 2005, Philadelphia, Mar. 2005.

Y. Ephraim, D. Malah. "Speech Enhancement Using a Minimum Mean-Square Error Short-Time Spectral Amplitude Estimator," IEEE Trans. On Acoustics, Speech, and Signal Processing, vol. ASSP-32, No. 6, Dec. 1984.

P. J. Wolfe and S. J. Godsill, "Simple alternatives to the Ephraim and Malah suppression rule for speech enhancement," In Proceedings of the IEEE Workshop on Statistical Signal Processing, pp. 496-499, 2001.

H. S. Malvar, "A modulated complex lapped transform and its applications to audio processing," ICASSP 99, Phoenix, pp. 1421-1424, Mar. 1999.

I. Tashev, "Gain calibration procedure for microphone arrays," ICME 2004, Taipei, Jun. 2004.

Jens Meyer, Noise Cancelling for Microphone Arrays, 1997, IEEE, pp. 211-213.

Pascal Scalart, Speech Enhacement Based on Priori Signal to Noise Estimation, 1996,IEEE, p. 629-632.

* cited by examiner a) *signal spatial variance* b) *noise spatial variance*

SPATIAL NOISE SUPPRESSION FOR A MICROPHONE ARRAY

CROSS-REFERENCE TO RELATED APPLICATION

The present application is a divisional of and claims priority of U.S. patent application Ser. No. 11/316,002, filed Dec. 22, 2005, the content of which is hereby incorporated by reference in its entirety.

BACKGROUND

The discussion above is merely provided for general background information and is not intended to be used as an aid in determining the scope of the claimed subject matter.

Small computing devices such as personal digital assistants (PDA), devices and portable phones are used with ever increasing frequency by people in their day-to-day activities. With the increase in processing power now available for microprocessors used to run these devices, the functionality of these devices is increasing, and in some cases, merging. For instance, many portable phones now can be used to access and browse the Internet as well as can be used to store personal information such as addresses, phone numbers and the like. Likewise, PDAs and other forms of computing devices are being designed to function as a telephone.

In many instances, mobile phones, PDAs and the like are increasingly being used in situations that require hands-free communication, which generally places the microphone assembly in a less than optimal position when in use. For instance, the microphone assembly can be incorporated in the housing of the phone or PDA. However, if the user is operating the device in a hands-free mode, the device is usually spaced significantly away from and not directly in front of the user's mouth. Environment or ambient noise can be significant relative to the user's speech in this less than optimal position. Stated another way, a low signal-to-noise ratio (SNR) is present for the captured speech. In view that mobile devices are commonly used in noisy environments, a low SNR is clearly undesirable.

To address this problem, at least in part, mobile phones and other devices can also be operated using a headset worn by the user. The headset includes a microphone and is connected either by wire or wirelessly to the device. For reasons of comfort, convenience and style, most users prefer headset designs that are compact and lightweight. Typically, these designs require the microphone to be located at some distance from the user's mouth, for example, alongside the user's head. This positioning again is suboptimal, and when compared to a well-placed, close-talking microphone, again yields a significant decrease in the SNR of the captured speech signal when compared to an optimal position.

One way to improve sound capture performance, with or without a headset, is to capture the speech signal using multiple microphones configured as an array. Microphone array processing improves the SNR by spatially filtering the sound field, in essence pointing the array toward the signal of interest, which improves overall directivity. However, noise reduction of the signal after the microphone array is still necessary and has had limited success with current signal processing algorithms.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

A noise reduction system and a method of noise reduction includes a microphone array comprising a first microphone, a second microphone, and a third microphone. Each microphone has a known position and a known directivity pattern. An instantaneous direction-of-arrival (IDOA) module determines a first phase difference quantity and a second phase difference quantity. The first phase difference quantity is based on phase differences between non-repetitive pairs of input signals received by the first microphone and the second microphone, while the second phase difference quantity is based on phase differences between non-repetitive pairs of input signals received by the first microphone and the third microphone. A spatial noise reduction module computes an estimate of a desired signal based on a priori spatial signal-to-noise ratio and an a posteriori spatial signal-to-noise ratio based on the first and second phase difference quantities.

DETAILED DESCRIPTION

One concept herein described provides spatial noise suppression for a microphone array. Generally, spatial noise reduction is obtained using a suppression rule that exploits the spatio-temporal distribution of noise and speech with respect to multiple dimensions.

However, before describing further aspects, it may be useful to first describe exemplary computing devices or environments that can implement the description provided below.

Figure 1:
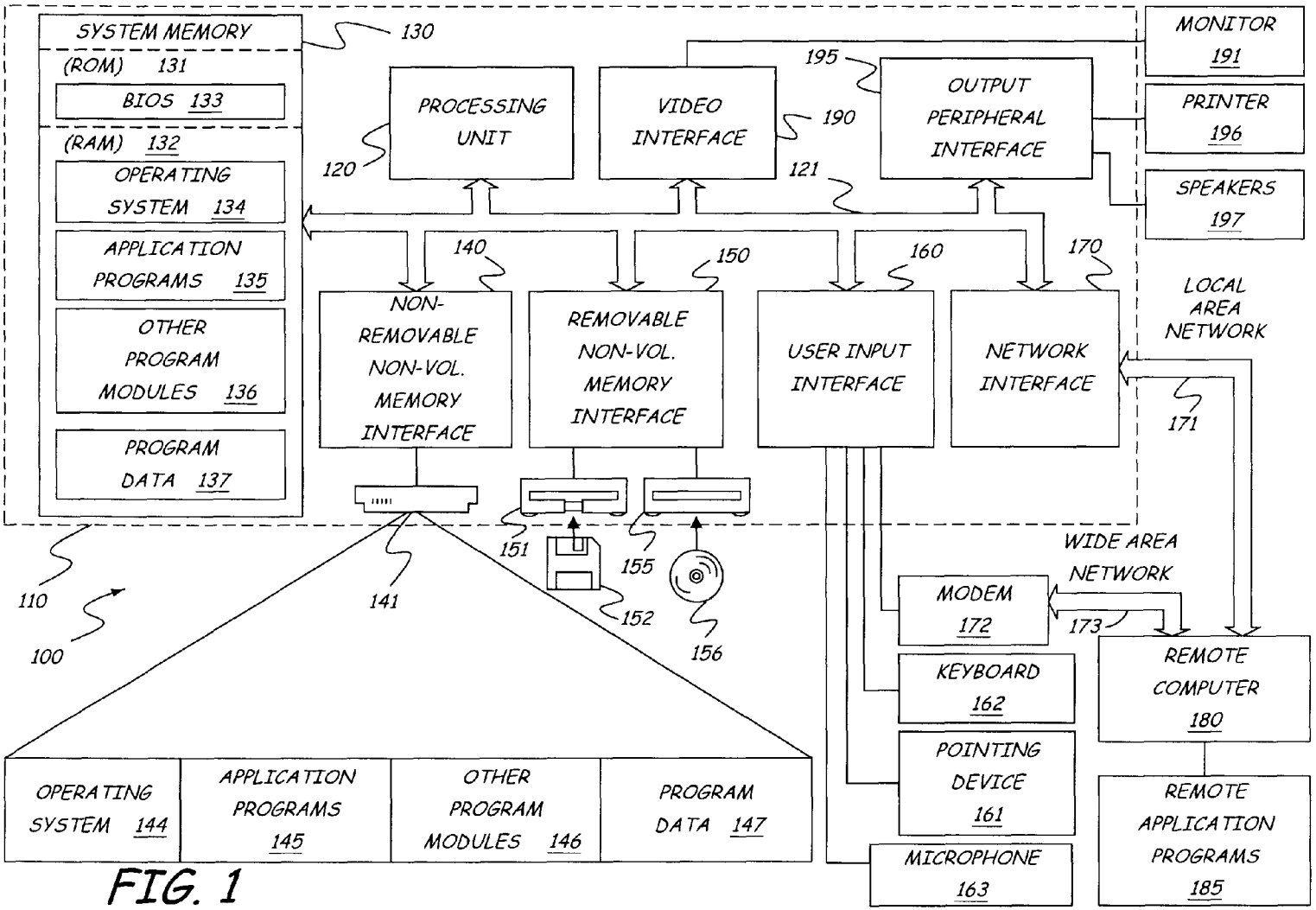
FIG. 1 is a block diagram of an embodiment of a computing environment.

FIG. 1 illustrates a first example of a suitable computing system environment 100 on which the concepts herein described may be implemented. The computing system environment 100 is again only one example of a suitable computing environment and is not intended to suggest any limitation as to the scope of use or functionality of the description below. Neither should the computing environment 100 be interpreted as having any dependency or requirement relating to any one or combination of components illustrated in the exemplary operating environment 100.

In addition to the examples herein provided, other well known computing systems, environments, and/or configurations may be suitable for use with concepts herein described. Such systems include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The concepts herein described may be embodied in the general context of computer-executable instructions, such as program modules, being executed by a computer. Generally, program modules include routines, programs, objects, components, data structures, etc. that perform particular tasks or implement particular abstract data types. Those skilled in the art can implement the description and/or figures herein as computer-executable instructions, which can be embodied on any form of computer readable media discussed below.

The concepts herein described may also be practiced in distributed computing environments where tasks are performed by remote processing devices that are linked through a communications network. In a distributed computing environment, program modules may be located in both locale and remote computer storage media including memory storage devices.

With reference to FIG. 1, an exemplary system includes a general purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a locale bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) locale bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 100. Communication media typically embodies computer readable instructions, data structures, program modules or other data in a modulated data signal such as a carrier WAV or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, FR, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way o example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone (herein an array) 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 190.

The computer 110 may operate in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a locale area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user-input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

It should be noted that the concepts herein described can be carried out on a computer system such as that described with respect to FIG. 1. However, other suitable systems include a server, a computer devoted to message handling, or on a distributed system in which different portions of the concepts are carried out on different parts of the distributed computing system.

Figure 2:
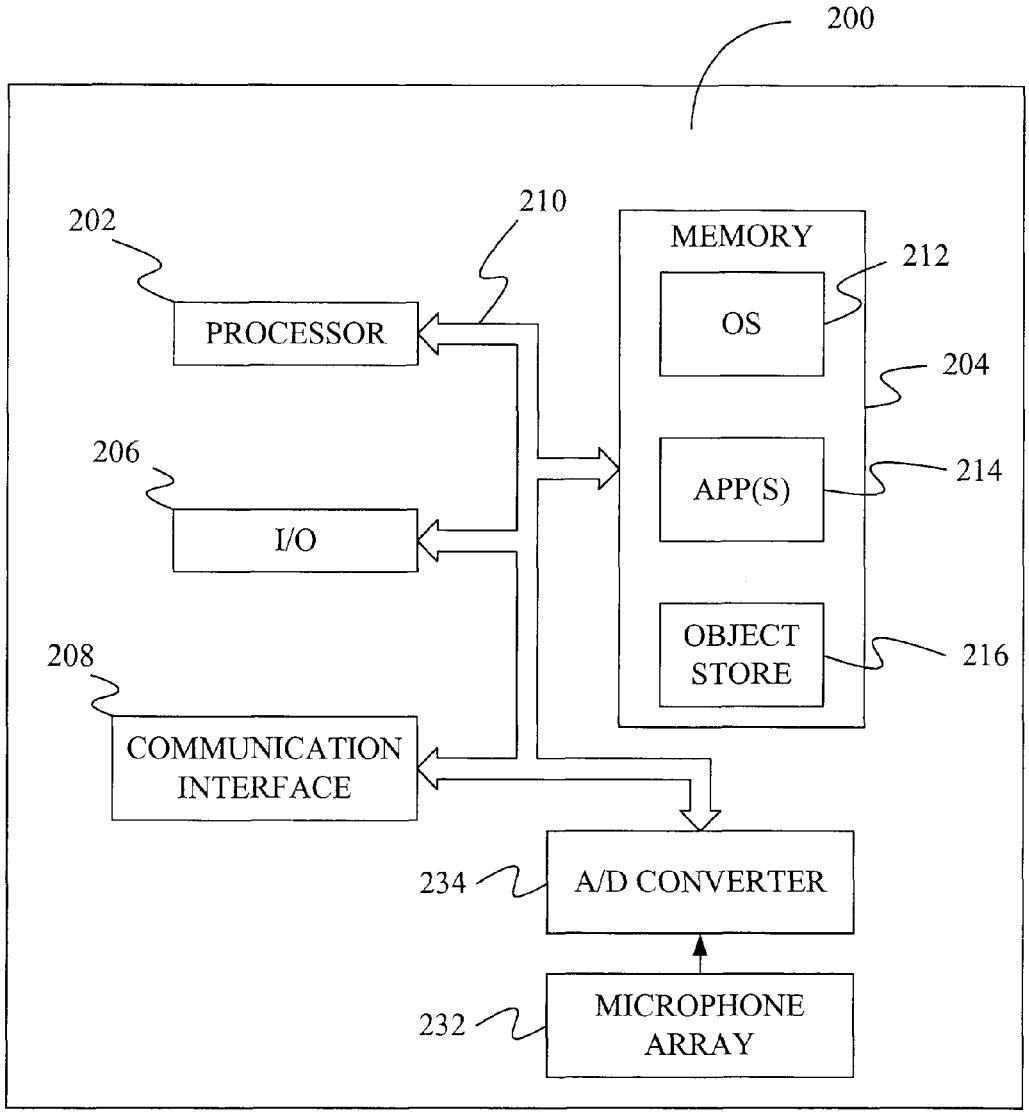
FIG. 2 is a block diagram of an alternative computing environment.

FIG. 2 is a block diagram of a mobile device 200, which is another exemplary computing environment. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212 is designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Mobile device 200 can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, as well as a variety of output devices including an audio generator, a vibrating device, and a display. The devices listed above are by way of example and need not all be present on mobile device 200.

However, in particular, device 200 includes an array microphone assembly 232, and in one embodiment, an optional analog-to-digital (A/D) converter 234, noise reduction modules described below and an optional recognition program stored in memory 204. By way of example, in response to audible information, instructions or commands from a user of device 200 generated speech signals are digitized by A/D converter 234. Noise reduction modules process the digitized speech signals to obtain an estimate of clean speech. A speech recognition program executed on device 200 or remotely can perform normalization and/or feature extraction functions on the clean speech signals to obtain intermediate speech recognition results. Using communication interface 208, speech data can be transmitted to a remote recognition server, not shown, wherein the results of which are provided back to device 200. Alternatively, recognition can be performed on device 200. Computer 110 processes speech input from microphone array 163 in a similar manner to that described above.

Figure 3:
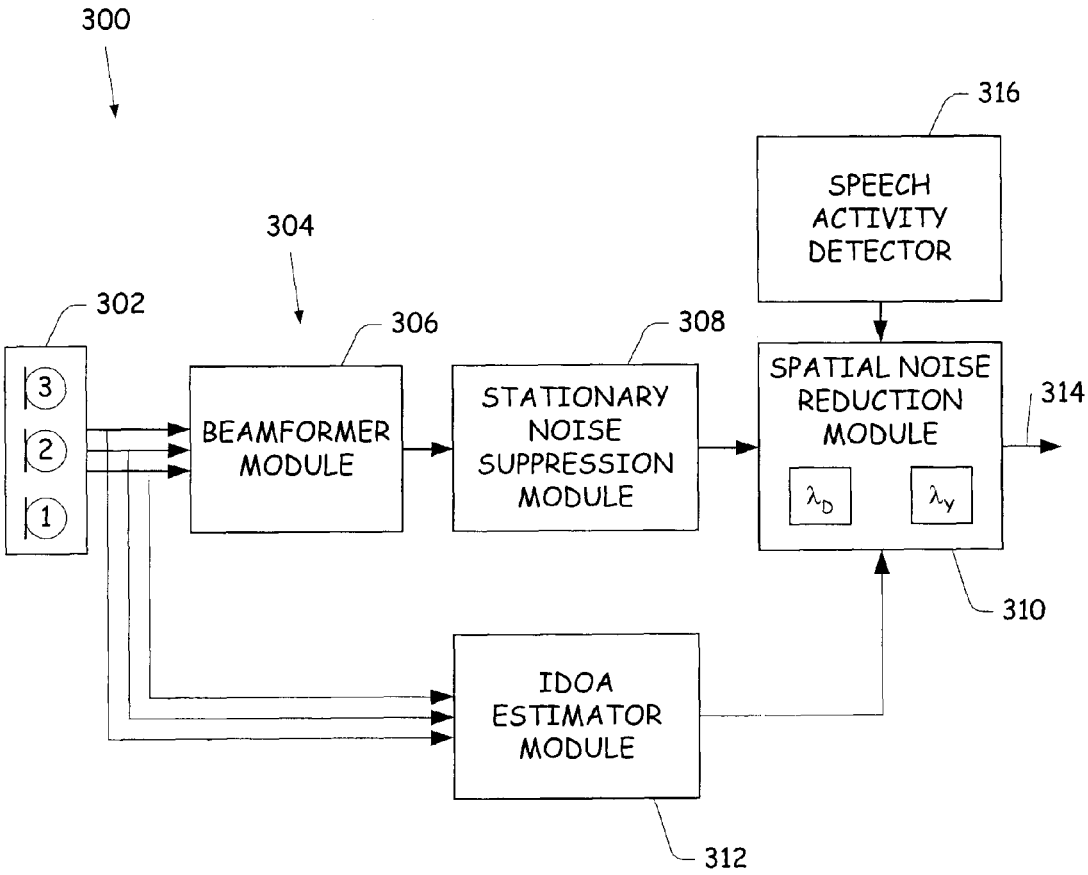
FIG. 3 is a block diagram of a microphone array and processing modules.

FIG. 3 schematically illustrates a system 300 having a microphone array 302 (representing either microphone 163 or microphone 232 and associated signal processing devices such as amplifiers, AD converters, etc.) and modules 304 to provide noise suppression. Generally, modules for noise suppression include a beamforming module 306, a stationary noise suppression module 308 designed to remove any residual ambient or instrumental stationary noise, and a novel spatial noise reduction module 310 designed to remove directional noise sources by exploiting the spatio-temporal distribution of the speech and the noise to enhance the speech signal. The spatial noise reduction module 310 receives as input instantaneous direction-of-arrival (IDOA) information from IDOA estimator module 312.

At this point it should be noted, that in one embodiment, the modules 304 (modules 306, 308, 310 and 312) can operate as a computer process entirely within a microphone array computing device, with the microphone array 302 receiving raw audio inputs from its various microphones, and then providing a processed audio output at 314. In this embodiment, the microphone array computing device includes an integral computer processor and support modules (similar to the computing elements of FIG. 2), which provides for the processing techniques described herein. However, microphone arrays with integral computer processing capabilities tend to be significantly more expensive than would be the case if all or some of the computer processing capabilities could be external to the microphone array 302. Therefore in another embodiment, the microphone array 302 only includes microphones, preamplifiers, A/D converters, and some means of connectivity to an external computing device, such as, for example, the computing devices described above. In yet another embodiment, only some of the modules 304 form part of the microphone array computing device.

When the microphone array 302 contains only some of the modules 304 or simply contains sufficient components to receive audio signals from the plurality of microphones forming the array and provide those signals to an external computing device which then performs the remaining processes, device drivers or device description files can be used. Device drivers or device description files contain data defining the operational characteristics of the microphone array, such as gain, sensitivity, array geometry, etc., and can be separately provided for the microphone array 302, so that the modules residing within the external computing device can be adjusted automatically for that specific microphone array.

In one embodiment, beamformer module 306 employs a time-invariant or fixed beamformer approach. In this manner, the desired beam is designed off-line, incorporated in beamformer module 306 and used to process signals in real time. However, although this time-invariant beamformer will be discussed below, it should be understood that this is but one exemplary embodiment and that other beamformer approaches can be used. In particular, the type of beamformer herein described should not be used to limit the scope or applicability of the spatial noise reduction module 310 described below.

Generally, the microphone array 302 can be considered as having M microphones with known positions. The microphones or sensors sample the sound field at locations Pm=$(x_m,y_m,z_m)$ where m={1, . . . , M} is the microphone index. Each of the m sensors has a known directivity pattern $U_m(f,c)$, where f is the frequency band index and c represents the location of the sound source in either a radial or a rectangular coordinate system. The microphone directivity pattern is a complex function, providing the spatio-temporal transfer function of the channel. For an ideal omni-directional microphone, $U_m(f,c)$ is constant for all frequencies and source locations. A microphone array can have microphones of different types, so $U_m(f,c)$ can vary as a function of m.

As is known to those skilled in the art, a sound signal originating at a particular location, c, relative to a microphone array is affected by a number of factors. For example, given a sound signal, S(f), originating at point c, the signal actually captured by each microphone can be defined by Equation (1), as illustrated below:

$$X_m(f,P_m)=D_m(f,c)A_m(f)U_m(f,C)S(f) \quad \text{Eq. 1}$$

where $D_m(f,c)$ represents the delay and the decay due to the distance between the source and the microphone. This is expressed as $$D_m(f,c)=F_m(f,c)\frac{e^{-j2\pi fv\|c-p_m\|}}{\|c-p_m\|} \quad \text{Eq. 2}$$

where V is the speed of sound and $F_m(f,c)$ represents the spectral changes in the sound due to the directivity of the human mouth and the diffraction caused by the user's head. It is assumed that the signal decay due to energy losses in the air can be ignored. The term $A_m(f)$ in Eq. (1) is the frequency response of the system preamplifier and analog-to-digital conversion (ADC). In most cases we can use the approximation $A_m(f)$=

The exemplary beamformer design described herein operates in a digital domain rather than directly on the analog signals received directly by the microphone array. Therefore, any audio signals captured by the microphone array are first digitized using conventional A/D conversion techniques. To avoid unnecessary aliasing effects, the audio signal is processed into frames longer than two times the period of the lowest frequency in a modulated complex lapped transform (MCLT) work band.

The beamformer herein described uses the modulated complex lapped transform (MCLT) in the beam design because of the advantages of the MCLT for integration with other audio processing components, such as audio compression modules. However, the techniques described herein are easily adaptable for use with other frequency-domain decompositions, such as the FFT or FFT-based filter banks, for example.

Figure 4:
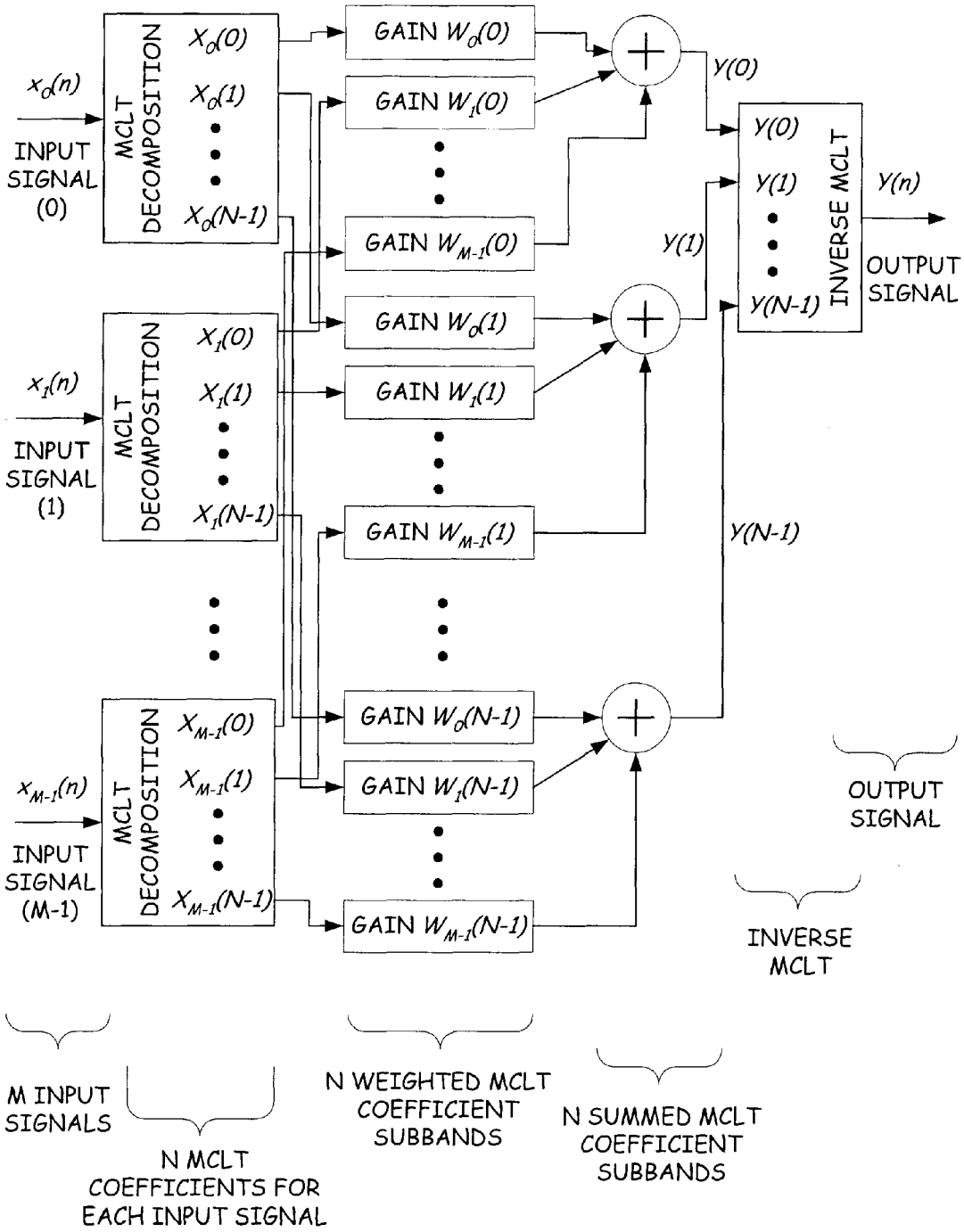
FIG. 4 is a block diagram of a beamforming module.

Assuming that the audio signal is processed in frames longer than twice the period of the lowest frequency in the frequency band of interest, the signals from all sensors are combined using a filter-and-sum beamformer as:

$$Y(f)=\sum_{m=1}^{M} W_m(f)X_m(f) \quad \text{Eq. 3}$$

where $W_m(f)$ are the weights for each sensor m and subband f, and Y(f) is the beamformer output. (Note: Throughout this description the frame index is omitted for simplicity.) The set of all coefficients $W_m(f)$ is stored as an N×M complex matrix W, where N is the number of frequency bins (e.g. MCLT) in a discrete-time filter bank, and M is the number of microphones A block diagram of the beamformer is provided in FIG. 4.

The matrix W is computed using the known methodology described by I. Tashev, H. Malvar, in "A New Beamformer Design Algorithm for Microphone Arrays," published by ICASSP 2005, Philadelphia, March 2005, or U.S. Patent Application US2005/0195988, published Sep. 8, 2005. In order to do so, the filter $F_m(f,C)$ in Eq. (2) must be determined. Its value can be estimated theoretically using a physical model, or measured directly by using a close-talking microphone as reference.

However, it should be noted again the beamformer herein described is but an exemplary type, wherein other types can be employed.

In any beamformer design, there is a tradeoff between ambient noise reduction and the instrumental noise gain. In one embodiment, more significant ambient noise reduction was utilized at the expense of increased instrumental noise gain. However, this additional noise is stationary and it can easily be removed using stationary noise suppression module 308. Besides removing the stationary part of the ambient noise remaining after the time-invariant beamformer, the stationary noise suppression module 308 reduces the instrumental noise from the microphones and preamplifiers.

Stationary noise suppression modules are known to those skilled in the art. In one embodiment, stationary noise suppression module 308 can use a gain-based noise suppression algorithm with MMSE power estimation and a suppression rule similar to that described by P. J. Wolfe and S. J. Godsill, in "Simple alternatives to the Ephraim and Malah suppression rule for speech enhancement," published in the Proceedings of the IEEE Workshop on Statistical Signal Processing, pages 496-499, 2001. However, it should be understood that this is but one exemplary embodiment and that other stationary noise suppression modules can be used. In particular, the type of stationary noise suppression module herein described should not be used to limit the scope or applicability of the spatial noise reduction module 310 described below.

The output of the stationary noise suppression module 308 is then processed by spatial noise suppression module 310. Operation of module 310 can be explained as follows. For each frequency bin f the stationary noise suppressor output $Y(f)\triangleq R(f).\exp(j\theta(f))$ consists of signal $S(f)\triangleq A(f).\exp(j\alpha(f))$ and noise D(f). If it is assumed that they are uncorrelated, then $Y(f)\triangleq S(f)+D(f)$.

Given an array of microphones, the instantaneous direction-of-arrival (IDOA) information for a particular frequency bin can be found based on the phase differences of non-repetitive pairs of input signals. In particular, for M microphones (where M equals at least three) these phase differences form an M−1 dimensional space, spanning all potential IDOA. In one embodiment as illustrated in FIG. 1, the microphone array 302 consists of three microphones (M=3), in which case two phase differences quantities $\delta_1(f)$ (between microphones 1 and 2) and $\delta_2(f)$ (between microphones 1 and 3) exist, thereby forming a two-dimensional space. In this space each physical point from the real space has a corresponding point. However, the opposite is not correct, i.e. there are points in this two-dimensional space without corresponding points in the real space.

As appreciated by those skilled in the art, the technique described herein can be extended to more than three microphones. Generally, if an IDOA vector is defined in this space as $$\Delta(f) \triangleq [\delta_1(f), \delta_2(f), \ldots, \delta_{M-1}(f)] \quad \text{Eq. 4}$$

where $$\delta_{j-1}(f) = arg(X_1(f)) - arg(X_j(f)) j = \{2, \ldots, M\} \quad \text{Eq. 5}$$

then the signal and noise variances in this space can be defined as $$\lambda_Y(f|\Delta) \triangleq E[|Y(f|\Delta)|^2]$$

$$\lambda_D(f|\Delta) \triangleq E[|D(f|\Delta)^2] \quad \text{Eq. 6}$$

The a priori spatial SNR $\xi(f|\Delta)$ and the a posteriori spatial SNR $\gamma(f,\Delta)$ can be defined as follows:

$$\xi(f \mid \Delta) \triangleq \beta \frac{\lambda_Y(f \mid \Delta) - \lambda_D(f \mid \Delta)}{\lambda_D(f \mid \Delta)} + (1-\beta)\max[0, \gamma(f \mid \Delta)], \quad \text{Eq. 7}$$

$$\beta \in [0, 1)$$

$$\gamma(f \mid \Delta) \triangleq \frac{|Y(f|\Delta|^2}{\lambda_D(f \mid \Delta)} \quad \text{Eq. 8}$$

Based on these equations and the minimum-mean square error spectral power estimator, the suppression rule can be generalized to $$H(f \mid \Delta) = \sqrt{\frac{\xi(f \mid \Delta)}{1+\xi(f \mid \Delta)}\left(\frac{1+\partial(f \mid \Delta)}{\gamma(f \mid \Delta)}\right)} \quad \text{Eq. 9}$$

where $\partial(f|\Delta)$ is defined as $$\partial(f \mid \Delta) \triangleq \frac{\xi(f \mid \Delta)}{1+\xi(f \mid \Delta)}\gamma(f \mid \Delta). \quad \text{Eq. 10}$$

Thus, for each frequency bin of the beamformer output, the IDOA vector $\Delta(f)$ is estimated based on the phase differences of the microphone array input signals $\{X_{i(f)}, \ldots, X_M(f)\}$. The spatial noise suppressor output for this frequency bin is then computed as $$A(f) = H(f|\Delta) \cdot |Y(f)| \quad \text{Eq. 11}$$

which can be used to obtain an estimate of the clean speech signal (desired signal) from $S(f) \triangleq A(f).\exp(j\theta(f))$.

Note that this is a gain-based estimator and accordingly the phase of the beamformer output signal is directly applied.

Figure 5:
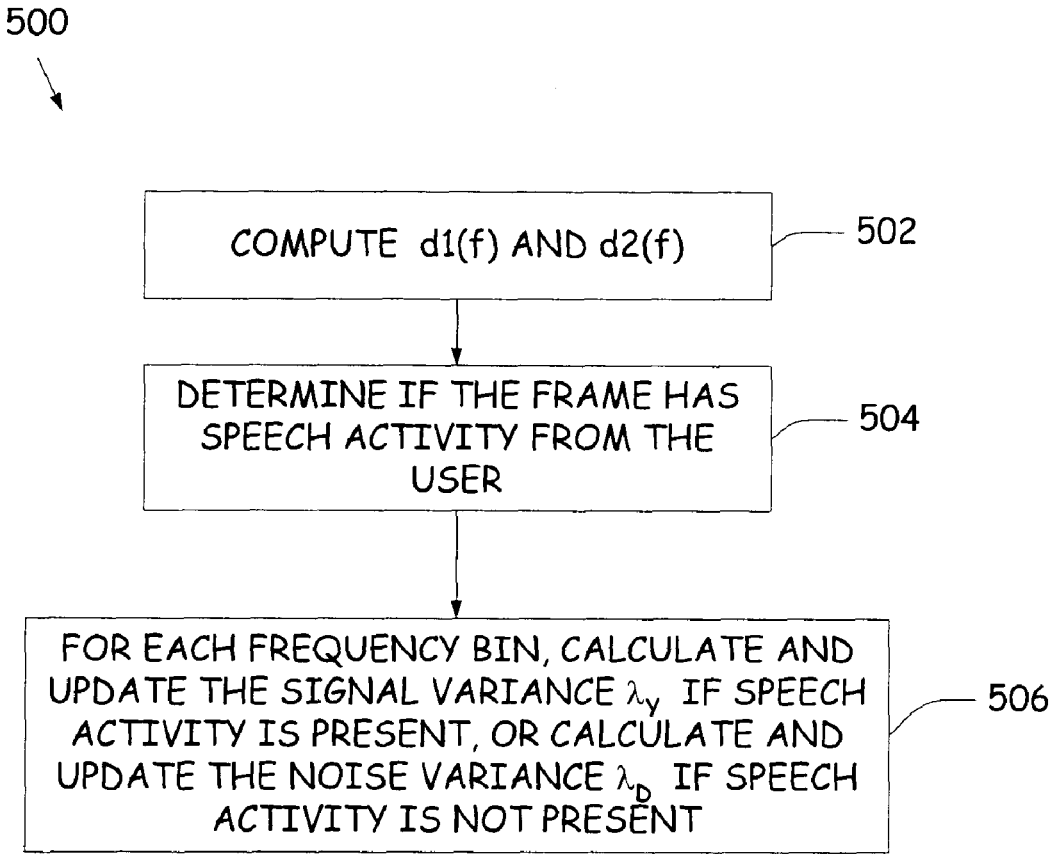
FIG. 5 is a flowchart of a method for updating signal and noise variance models.

Method 500 provided in FIG. 5 illustrates steps for updating the noise and input signal variance models $\lambda_Y$ and $\lambda_D$ of spatial noise reduction module 310, which will be described with respect to a microphone array having three microphones. Method 500 is performed for each frame of audio signal. At step 502, $\delta_1(f)$ (phase difference between of non-repetitive input signals of microphones 1 and 2) and $\delta_2(f)$ (phase difference between of non-repetitive input signals of microphones 1 and 3) are computed (herein obtained from IDOA estimator module 312).

At step 504, a determination is made as to whether the frame has a desired signal relative to noise therein. In the embodiment described, the desired signal is speech activity from the user, for example, whether the user of the headset having the microphone array is speaking. (However, in another embodiment, the desired signal could take any number of forms.)

At step 504, in the exemplary embodiment herein described, each audio frame is classified as having speech from the user therein or just having noise. In FIG. 1, a speech activity detector is illustrated at 316 and can comprise a physical sensor such as a sensor that detects the presence of vibrations in the bones of the user, which are present when the user speaks, but not significantly present when only noise is present. In another embodiment, the speech activity detector 316 can comprise another module of modules 304. For instance, the speech activity detector 316 may determine that speech activity exists when energy above a selected threshold is present. As appreciated by those skilled in the art, numerous types of modules and/or sensors can be used to perform the function of detecting the presence of the desired signal.

At step 506, based on whether the user is speaking during a given frame, the signal or noise spatial variance $\lambda_Y$ and $\lambda_D$ as provided by Eq. 6 is calculated for each frequency bin and used in the corresponding signal or noise model at the dimensional space computed at step 502.

In practical realizations of the proposed spatial noise reduction algorithm implemented by module 310, the (M−1)-dimensional space of the phase differences is mathematically discrete or discretized. Empirically, it has been found that using 10 bins to cover the range $[-\pi,+\pi]$ provided adequate precision and results in a resolution of the differences in the phases of 36°. This converts $\lambda_Y$ and $\lambda_D$ to square matrices for each frequency bin. In addition to updating the current cell in $\lambda_Y$ and $\lambda_D$, the averaging operator E[ ] can perform "aging" of the values in the other matrix cells.

In one embodiment, to increase the adaptation speed of the spatial noise suppressor, the signal and noise variance matrices $\lambda_Y$ and $\lambda_D$ are computed for a limited number of equally spaced frequency subbands. The values for the remaining frequency bins can then be computed using a linear interpolation or nearest neighbor technique. Also in another embodiment, the computed value for a frequency bin can be duplicated or used for other frequencies having the same dimensional space position. In this manner, the signal and noise variance matrices $\lambda_Y$ and $\lambda_D$ can adapt quicker, for example, for moving noise.

Figure 6:
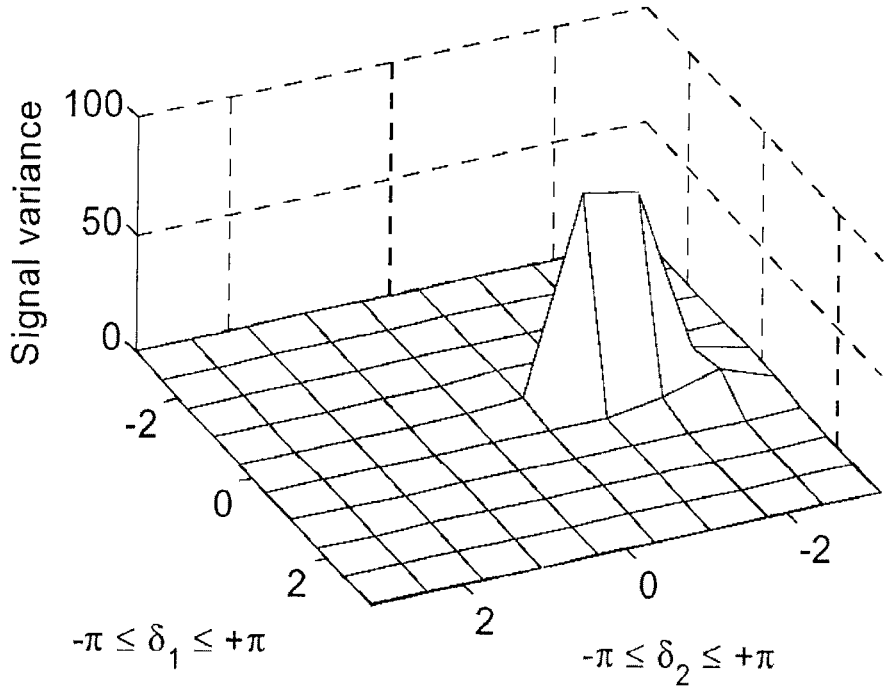
FIGS. 6A and 6B are plots of exemplary signal and noise spatial variance relative to two-dimensional phase differences of microphones at a selected frequency.
Figure 6:
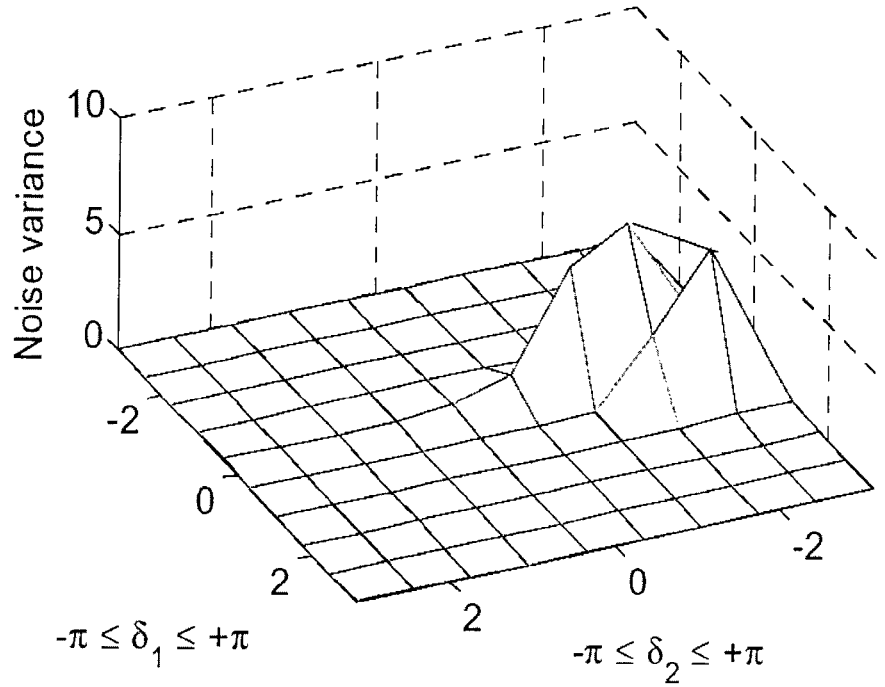

By way of example, the variance matrices for the subband around 1000 Hz are shown in FIGS. 6A and 6B. Note that the vertical axis is different in each plot. These variances were measured under 75 dB SPL ambient cocktail-party noise. FIGS. 6A and 6B clearly show that the signal from the speaker is concentrated in certain area—direction 0°. The uncorrelated instrumental noise is spread evenly in the whole angular space, while the correlated ambient noise is concentrated around the DOA trace $0-\pi/2-\pi$. Due to the beamformer, the variance decreases as it goes farther from the focus point at 0°.

Figure 7:
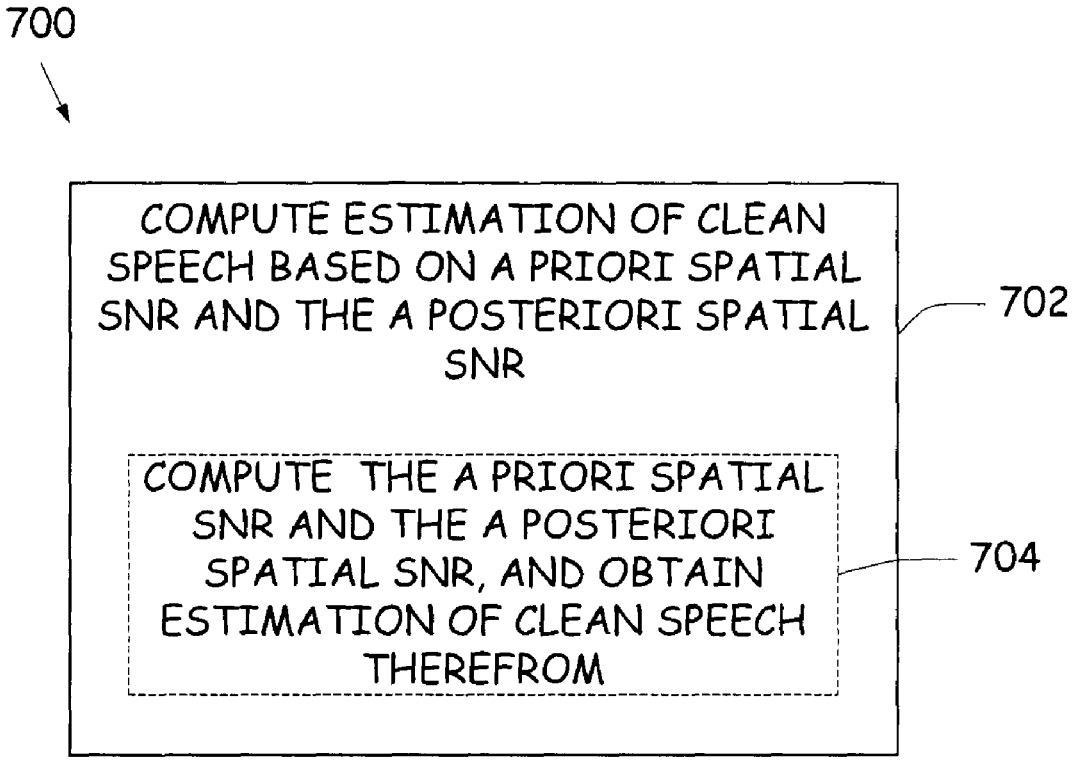
FIG. 7 is a flowchart of a method for estimating a desired signal such as clean speech.

Method 700 in FIG. 7 illustrates the steps for estimating the clean speech signal based on the signal and noise variances described above, which can include the adaptation described with respect to FIG. 5. At step 702, an estimation of clean speech is obtained based on the a priori spatial SNR $\xi(f|A)$ and the a posteriori spatial SNR $\gamma(f,\Delta)$. Commonly, this would include using appropriate code that embodies Equations 7-11. However, for purposes of understanding this can be obtained by explicitly computing the a priori spatial SNR $\gamma(f,\Delta)$ and the a posteriori spatial SNR $\gamma(f,\Delta)$. based on Eq. 7 and 8 at step 704, and using equations 9-11, to obtain an estimation of the clean speech signal therefrom.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims.

What is claimed is:

1. A noise reduction system comprising:

a microphone array comprising a first microphone, a second microphone, and a third microphone, wherein each microphone has a known position and a known directivity pattern;

an instantaneous direction-of-arrival (IDOA) module that determines a first phase difference quantity and a second phase difference quantity, wherein the first phase difference quantity is based on phase differences between non-repetitive pairs of input signals received by the first microphone and the second microphone, and wherein the second phase difference quantity is based on phase differences between non-repetitive pairs of input signals received by the first microphone and the third microphone; and a spatial noise reduction module that computes an estimate of a desired signal based on an a priori spatial signal-to-noise ratio and an a posteriori spatial signal-to-noise ratio, wherein the a priori spatial signal-to-noise ratio and the a posteriori signal-to-noise ratio are each based on the first and second phase difference quantities.

2. The noise reduction system of claim 1 wherein the first phase difference quantity and the second phase difference quantity form a two-dimensional space, and wherein the a priori spatial signal-to-noise ratio and the a posteriori signal-to-noise ratio are each based on the two-dimensional space.

3. The noise reduction system of claim 2 wherein the two-dimensional space is mathematically discrete.

4. The noise reduction system of claim 3 wherein each physical point from a real space has a corresponding point in the two-dimensional space.

5. The noise reduction system of claim 4 wherein at least two of the microphones are of different types.

6. The noise reduction system of claim 1 and further comprising a fourth microphone and wherein the IDOA module determines a third phase difference quantity, wherein the third phase difference quantity is based on phase differences between non-repetitive pairs of input signals received by the first microphone and the fourth microphone.

7. The noise reduction system of claim 6 wherein the first phase difference quantity, the second phase difference quantity, and the third phase difference quantity form a three-dimensional space, and wherein the a priori spatial signal-to-noise ratio and the a posteriori signal-to-noise ratio are each based on the three-dimensional space.

8. A method of reducing noise comprising:

providing a microphone array comprising a first microphone, a second microphone, and a third microphone, wherein each microphone has a known position and a known directivity pattern;

determining a first phase difference quantity and a second phase difference quantity, wherein the first phase difference quantity is based on phase differences between non-repetitive pairs of input signals received by the first microphone and the second microphone, and wherein the second phase difference quantity is based on phase differences between non-repetitive pairs of input signals received by the first microphone and the third microphone; and with a computer, computing an estimate of a desired signal based on an a priori spatial signal-to-noise ratio and an a posteriori spatial signal-to-noise ratio, wherein the a priori spatial signal-to-noise ratio and the a posteriori signal-to-noise ratio are each based on the first and second phase difference quantities.

9. The method of reducing noise of claim 8 wherein the first phase difference quantity and the second phase difference quantity form a two-dimensional space, and wherein the a priori spatial signal-to-noise ratio and the a posteriori signal-to-noise ratio are each based on the two-dimensional space.

10. The method of reducing noise of claim 9 wherein the two-dimensional space is mathematically discrete.

11. The method of reducing noise of claim 10 wherein each physical point from a real space has a corresponding point in the two-dimensional space.

12. The method of reducing noise of claim 11 wherein at least two of the microphones are of different types.

13. The method of reducing noise of claim 8 and further comprising a fourth microphone and wherein determining includes determining a third phase difference quantity, wherein the third phase difference quantity is based on phase differences between non-repetitive pairs of input signals received by the first microphone and the fourth microphone.

14. The method of reducing noise of claim 13 wherein the first phase difference quantity, the second phase difference quantity, and the third phase difference quantity form a three-dimensional space, and wherein the a priori spatial signal-to-noise ratio and the a posteriori signal-to-noise ratio are each based on the three-dimensional space.

* * * * *